US009715780B2

(12) United States Patent
Garrison

(10) Patent No.: US 9,715,780 B2
(45) Date of Patent: Jul. 25, 2017

(54) METHOD AND APPARATUS FOR A SOLAR POWERED STORAGE SYSTEM

(71) Applicant: GARRSNLOCKR LLC, District Heights, MD (US)

(72) Inventor: James E. Garrison, District Heights, MD (US)

(73) Assignee: GARRSNLOCKR LLC, District Heights, MD (US)

( * ) Notice: Subject to any disclaimer, the term of this patent is extended or adjusted under 35 U.S.C. 154(b) by 394 days.

(21) Appl. No.: 13/888,072

(22) Filed: May 6, 2013

(65) Prior Publication Data

US 2013/0307382 A1 Nov. 21, 2013

Related U.S. Application Data

(60) Provisional application No. 61/647,030, filed on May 15, 2012.

(51) Int. Cl.

| | |
|---|---|
| ***E05B 65/46*** | (2017.01) |
| ***G07F 17/12*** | (2006.01) |
| ***G07F 9/10*** | (2006.01) |

(52) U.S. Cl.

CPC ..... *G07F 17/12* (2013.01); *G07F 9/105* (2013.01)

(58) Field of Classification Search

CPC ..... G07F 17/12; G07F 9/105; G07C 9/00166; G07C 9/00912

USPC ..... 312/215, 237, 234; 340/5.5, 5.73, 5.61; 700/236, 241, 244

See application file for complete search history.

(56) References Cited

U.S. PATENT DOCUMENTS

| | | | | |
|---|---|---|---|---|
| 3,710,736 A * | 1/1973 | Biondi | A47B 61/00 | 109/50 |
| 4,164,907 A * | 8/1979 | Piatscheck | E05G 1/08 | 109/50 |
| 4,204,635 A * | 5/1980 | Hofmann | G06Q 10/02 | 235/382 |
| 4,894,717 A * | 1/1990 | Komei | A47G 29/141 | 348/14.01 |
| 5,143,108 A * | 9/1992 | Kenney | A45B 3/00 | 108/151 |

(Continued)

FOREIGN PATENT DOCUMENTS

CA WO2009146543 A1 12/2009

*Primary Examiner* — Daniel J Troy
*Assistant Examiner* — Timothy M Ayres
(74) *Attorney, Agent, or Firm* — Hauptman Ham, LLP

(57) ABSTRACT

An approach is provided to facilitate storage space rental services from a self sustaining solar powered storage locker rental system that may be remotely monitored and controlled. The apparatus includes one or more storage lockers each having respective electronic locking mechanisms. The apparatus is configured to process a request to access a storage locker and determine storage locker availability. The apparatus displays which of the one or more storage lockers is available and processes a selection of an available storage locker to generate an access message that includes a locker number, a randomly generated access code, and a duration of access indication based on a confirmed financial transaction. The apparatus also includes at least one solar energy collection unit configured to collect solar energy, and an energy storage unit configured to store the collected solar energy and supply power to the apparatus.

19 Claims, 7 Drawing Sheets

(56) References Cited

U.S. PATENT DOCUMENTS

| | | | | |
|---|---|---|---|---|
| 5,212,644 | A * | 5/1993 | Frisch | 705/418 |
| 6,109,297 | A * | 8/2000 | Shackelford | F16K 51/00 137/527.6 |
| 6,791,450 | B2 | 9/2004 | Gokcebay et al. | |
| 6,999,825 | B2 * | 2/2006 | Inomata | G07F 17/0014 340/5.73 |
| 8,497,656 | B2 * | 7/2013 | Portis, Jr. | A45B 3/00 136/243 |
| 2004/0031513 | A1 * | 2/2004 | Bunch | A45B 3/04 135/16 |
| 2005/0179349 | A1 * | 8/2005 | Booth et al. | 312/257.1 |
| 2006/0116132 | A1 * | 6/2006 | Le Gars | 455/456.1 |
| 2006/0124157 | A1 * | 6/2006 | Bayour | A45B 3/10 135/16 |
| 2007/0220933 | A1 * | 9/2007 | Gagosz et al. | 70/233 |
| 2008/0027794 | A1 * | 1/2008 | Le Gars et al. | 705/13 |
| 2009/0240575 | A1 * | 9/2009 | Bettez et al. | 705/13 |
| 2010/0275642 | A1 * | 11/2010 | Klettner | A45C 11/20 62/457.7 |
| 2012/0020060 | A1 * | 1/2012 | Myer | F21S 2/00 362/183 |
| 2012/0086314 | A1 * | 4/2012 | Bourke et al. | 312/109 |
| 2013/0033222 | A1 * | 2/2013 | Hixson et al. | 320/101 |
| 2015/0120601 | A1 * | 4/2015 | Fee | G06Q 10/0836 705/339 |

* cited by examiner

METHOD AND APPARATUS FOR A SOLAR POWERED STORAGE SYSTEM

RELATED APPLICATION

This application claims the benefit of the earlier filing date of U.S. Provisional Application Ser. No. 61/647,030 filed May 15, 2012, entitled "Garrsn Lockr," the entirety of which is incorporated herein by reference, under 35 U.S.C. §119 (e).

BACKGROUND

Conventional locker rental systems often employ key-operated locking mechanisms or stagnant combination locking mechanisms that are easily manipulated, lost, forgotten, and unable to be controlled and monitored from afar. Such conventional locker systems may be located at an amusement park, shopping center, tourist destination, etc. Some other types of locker rental systems may include electronic locking mechanisms that require a constant power supply for operation, and accordingly must be located near an available power source. Conventional key-operated locking mechanisms and stagnant combination locking mechanism, however, need not be located near an available power source because such locking mechanisms do not require a constant power supply.

Some Example Embodiments

Therefore, there is a need for an approach to provide storage space rental services from a self sustaining solar powered storage locker rental system that may be remotely monitored and controlled.

According to one embodiment, a method comprises processing a request to access at least one storage locker that is among one or more storage lockers associated with a storage locker rental apparatus to determine at least one of the one or more storage lockers is available to be accessed. The one or more storage lockers are configured to store one or more items. Each of the one or more storage lockers comprise a top portion; a bottom portion distal the top portion; a first side portion having a first side portion length extending from the top portion to the bottom portion; a second side portion distal the first side portion having a second side portion length extending from the top portion to the bottom portion; a rear portion having a rear portion length extending from the top portion to the bottom portion and a rear portion width extending from the first side portion to the second side portion.

The top portion, bottom portion, first side portion, second side portion, and rear portion are arranged to form a cavity between them. The cavity has an opening distal the rear portion. A door portion is adjoined to the first side portion by at least one hinge. The door portion is configured to move between an open position and a closed position. The door portion is also configured to engage a door stop associated with the second side portion when the door portion is in the closed position. As such, when the door is in the closed position, the opening is sealed. The one or more storage lockers also each comprise an electronic locking mechanism configured to be in one of a locked and an unlocked status to cause a status of the door portion to be one of locked and unlocked when the door portion is in the closed position based, at least in part, on a lock instruction.

The method further comprises causing, at least in part, an accessibility report to be displayed on a user interface based, at least in part, on the request to access at least one of the one or more storage lockers. The accessibility report includes an indication of which of the one or more storage lockers is determined to be available to be accessed. The method also comprises processing a selection associated with a particular determined available storage locker to cause, at least in part, an access message to be generated and communicated based, at least in part, on a confirmed financial transaction. The access message comprises a locker number, an access code, and a duration of access indication of the selected available storage locker based on a selected time period for renting the selected available storage locker and an amount of money collected based on the confirmed financial transaction.

The method additionally comprises causing, at least in part, the lock instruction to be communicated to the electronic locking mechanism based, at least in part, on one or more of a reception of the access code and an access authorization indicator. The access authorization indicator is associated with one or more of the confirmed financial transaction associated with use of the at least one storage locker and a management system operator input. The method further comprises causing, at least in part, solar energy collected by at least one solar energy collection unit configured to collect solar energy to be stored by an energy storage unit configured to store the collected solar energy.

The method also comprises causing, at least in part, power to be supplied to the storage locker rental apparatus from the energy storage unit. The storage locker rental apparatus, accordingly, is independent of any external power source.

According to another embodiment, an apparatus comprises one or more storage lockers configured to store one or more items. The one or more storage lockers each comprise a top portion; a bottom portion distal the top portion; a first side portion having a first side portion length extending from the top portion to the bottom portion; a second side portion distal the first side portion having a second side portion length extending from the top portion to the bottom portion; a rear portion having a rear portion length extending from the top portion to the bottom portion and a rear portion width extending from the first side portion to the second side portion.

The top portion, bottom portion, first side portion, second side portion, and rear portion being arranged to form a cavity between them. The cavity has an opening distal the rear portion. A door portion is adjoined to the first side portion by at least one hinge. The door portion is configured to move between an open position and a closed position. The door portion is also configured to engage a door stop associated with the second side portion when the door portion is in the closed position. As such, the door portion seals the opening when the door portion is in the closed position. The one or more storage lockers each also comprise an electronic locking mechanism configured be in one of a locked and an unlocked status to cause a status of the door portion to be one of locked and unlocked when the door portion is in the closed position based, at least in part, on a lock instruction.

The apparatus also comprises at least one processor, and at least one memory including computer program code for one or more programs. The at least one memory and the computer program code are configured to, with the at least one processor, cause the apparatus to process a request to access at least one of the one or more storage lockers to determine at least one of the one or more storage lockers is available to be accessed. The apparatus is further caused to cause, at least in part, an accessibility report to be displayed on a user interface based, at least in part, on the request to access at least one of the one or more storage lockers. The accessibility report includes an indication of which of the one or more storage lockers is determined to be available to be accessed.

The apparatus is additionally caused to process a selection associated with a particular determined available storage locker to cause, at least in part, an access message to be generated and communicated based, at least in part, on a confirmed financial transaction. The access message comprises a locker number, an access code, and a duration of access indication of the selected available storage locker based on a selected time period for renting the selected available storage locker and an amount of money collected based on the confirmed financial transaction.

The apparatus is also caused to cause, at least in part, the lock instruction to be communicated to the electronic locking mechanism based, at least in part, on one or more of a reception of the access code and an access authorization indicator. The access authorization indicator is associated with one or more of the confirmed financial transaction associated with use of the at least one storage locker and a management system operator input.

The apparatus further comprises at least one solar energy collection unit configured to collect solar energy. The apparatus additionally comprises an energy storage unit configured to store the collected solar energy and supply power to the apparatus. The apparatus is accordingly independent of any external power source.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments are illustrated by way of example, and not by way of limitation, in the figures of the accompanying drawings.

DESCRIPTION OF SOME EMBODIMENTS

Examples of a method, apparatus, and computer program for providing storage space rental services from a self sustaining solar powered storage locker rental system that may be remotely monitored and controlled are disclosed. In the following description, for the purposes of explanation, numerous specific details are set forth in order to provide a thorough understanding of the embodiments. It is apparent, however, to one skilled in the art that the embodiments may be practiced without these specific details or with an equivalent arrangement. In other instances, well-known structures and devices are shown in block diagram form in order to avoid unnecessarily obscuring the embodiments.

Figure 1:
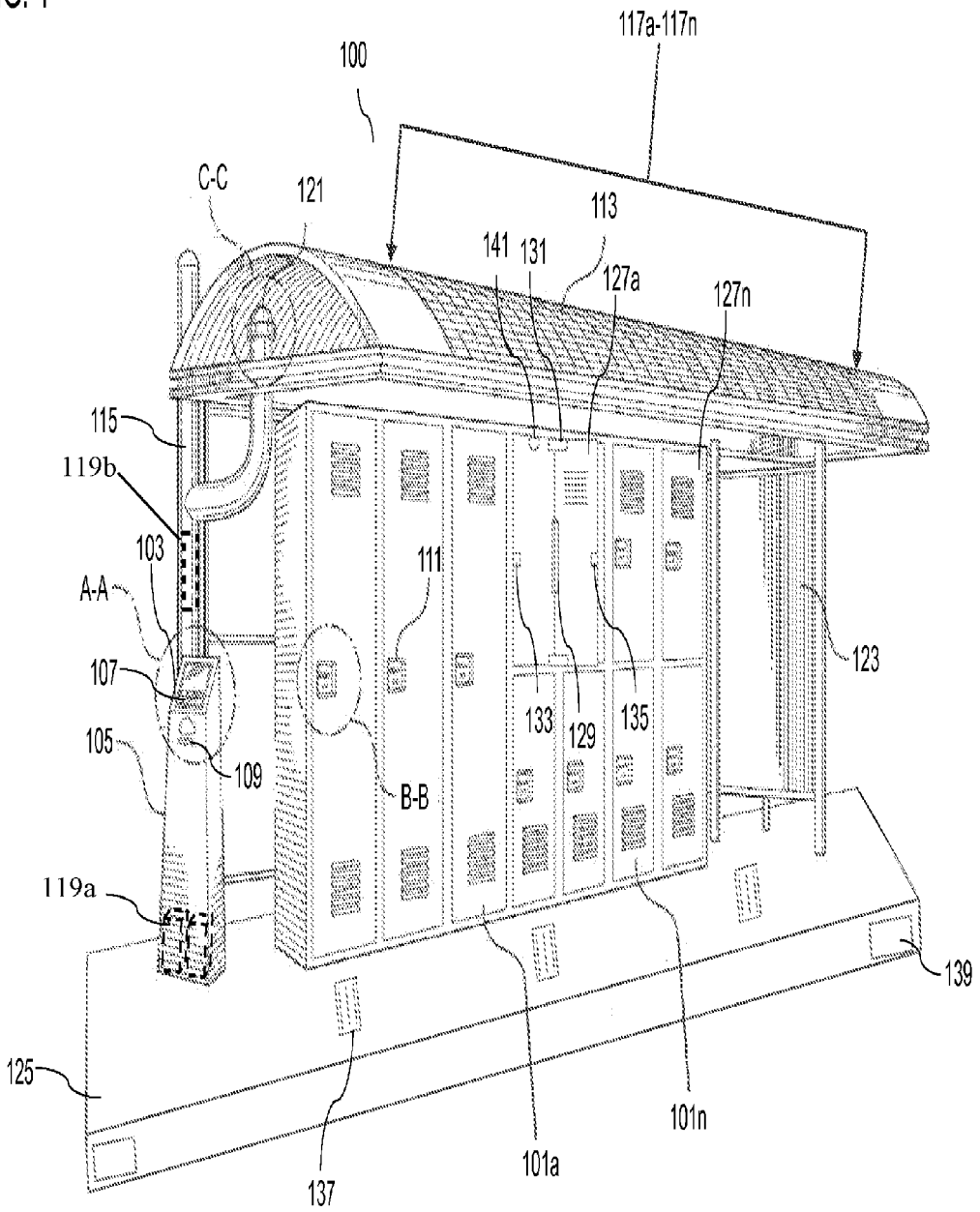
FIG. 1 is a diagram of a system capable of providing storage space rental services from a self sustaining solar powered storage locker rental system that may be remotely monitored and controlled, according to one embodiment.

FIG. 1 is a diagram of a system capable of providing storage space rental services from a self sustaining solar powered storage locker rental system that may be remotely monitored and controlled, according to one embodiment. Conventional storage locker rental systems often employ key-operated locking mechanisms or stagnant combination locking mechanisms that are easily manipulated, lost, forgotten, and unable to be controlled and monitored from afar. Such conventional storage locker systems, for example, may be located at an amusement park, shopping center, tourist destination, etc. Some other types of locker rental systems may include electronic locking mechanisms that require a constant power supply for operation, and accordingly must be located near an available power source. As such, storage locker rental systems having electronic locking mechanisms may only be placed in locations that have access to an available power source. Additionally, increased or added costs may be associated with placing a locker rental system in a location at which a power source must be provided. Conversely, conventional key-operated locking mechanisms and stagnant combination locking mechanisms need not be located near an available power source because such locking mechanisms do not require a constant power supply, and may therefore be placed in any location. In addition to inconvenient placement that may be associated with placing a storage locker rental unit near a power supply, utility costs associated with operating such a storage locker rental system may also affect the profitability of the storage locker rental system.

To address these problems, a system 100 of FIG. 1 introduces the capability to provide storage space rental services from a self sustaining solar powered storage locker rental system that may be remotely monitored and controlled. The system 100 enables a user to rent a storage locker on demand using any combination of a locally provided control unit having a user interface for selecting a desired available storage locker to rent and for conducting a financial transaction associated with renting the storage locker, and/or a user device having similar features. The system 100 is self sustaining such that it is independent of any external power sources to enable placement in areas of need that may, for example, not have a power source readily available.

As shown in FIG. 1, the system 100 comprises storage lockers 101*a*-101*n* (collectively referred to as storage locker 101), control unit 103, control unit housing 105, user interface 107, printing unit 109, one or more input interfaces 111, canopy portion 113, one or more canopy support members 115, solar energy collection units 117*a*-117*n* (collectively referred to as solar energy collection unit 117), one or more energy storage units 119*a*-119*b* (collectively referred to as energy storage unit(s) 119), video camera 121, display portion 123, and base member 125.

According to various embodiments, the system 100 may include any number of storage lockers 101 that may be of any size, for example, small, medium, and large, or any combination thereof, with regard to one another. For example, a system 100 may include an equal number of small, medium, and large lockers, or an unequal number of small, medium and large lockers depending on the overall footprint and size of the system 100. In some embodiments, the system 100 may comprise storage lockers 101 that are all of the same size.

In one or more embodiments, the sizes and layouts of the storage lockers 101 may be easily changeable by a system operator. For example, the storage lockers 101 may be modular and any of interconnect or be held together by various locker joining mechanisms such as couplings, bolts, screws, or electronic magnets that cause one or more storage lockers 101 to be bound together on demand. The one or more storage lockers 101 may be joined either as units comprising one or more storage lockers 101 or individually depending on the embodiment. For example, a unit of storage lockers may include 1, 2, 3, 4 or more storage lockers of a same or different size. In some embodiments, the storage lockers 101 may share wall portions between them each having their own corresponding door portion 127, or each have their own five individual wall portions and a corresponding door portion 127.

The storage lockers 101, regardless of size and whether particular wall portions are shared, each comprise a top portion, a bottom portion distal the top portion, a first side portion having a first side portion length extending from the top portion to the bottom portion, a second side portion distal the first side portion having a second side portion length extending from the top portion to the bottom portion, a rear portion having a rear portion length extending from the top portion to the bottom portion and a rear portion width extending from the first side portion to the second side portion.

The top portion, bottom portion, first side portion, second side portion, and rear portion of each of the storage lockers 101 are arranged to form a cavity between them. The cavity, for example, is an area within the storage locker 101 in which item may be placed for storage. The cavity has an opening distal the rear portion. The opening is a portion of the storage locker 101 through which the item to be stored may pass as it is placed inside the cavity.

The storage lockers 101 each also include door portions 127*a*-127*n* (collectively referred to as door portion 127) adjoined to the first side portion of the storage locker 101 by at least one hinge 129. The door portion 127 is configured to move between an open position and a closed position. For example, door portion 127*a* is illustrated as being in the open position, and door portion 127*n* is illustrated as being in the closed position. The door portion 127, in some embodiments, may be constrained by one or more linkages 131 such that the door portion 127 does not open beyond a predetermined amount such as 90 degrees from its closed position. The restricted range of motion of the door portion 127 between the closed position and its fully open position prevents the door portion 127 from interfering with usage of another storage locker 101.

The door portion 127 is further configured to engage a door stop 133 associated with the second side portion when the door portion is in the closed position. The opening is sealed when the door portion 127 is in the closed position.

In one or more embodiments, the storage lockers 101 include one or more electronic locking mechanisms 135 configured to be in one of an unlocked and a locked status to cause a status of the door portion 127 to also be one of locked and unlocked when the door portion 127 is in the closed position based, at least in part, on a lock instruction. For example, a lock instruction may indicate that the electronic locking mechanism 135 is to cause the status of the door portion to be locked, or unlocked. In some embodiments, the electronic locking mechanism 135 may comprise a magnetic locking system that is caused to be in the locked or unlocked status based upon a voltage being provided to the magnetic locking system. In other embodiments, the electronic locking mechanism 135 may additionally or alternatively include a mechanical locking means such as a tumbler or bolt lock that is actuated based on the lock instruction to be in the locked or unlocked status.

According to various embodiments, the system 100 includes at least one processor, such as a processor associated with the control unit 103 and at least one memory including computer program code for one or more programs also associated with the control unit 103 such as, but not limited to, a control platform.

A user interested in renting a storage locker 101 may, for example, address the control unit 103 and access the user interface 107. The user interface 107 may be a touch screen display that activates upon a determination that the user is within a predetermined proximity of the control unit 103, or when a user touches the touch screen display. The user may then request to access one of the storage lockers 101, meaning to begin a rental process associated with renting at least one of the storage lockers 101. For example, the user interface 107 may provide a plurality of options associated with renting a storage locker 101. The control unit 103 processes the request to access or rent at least one of the one or more storage lockers 101 to determine at least one of the one or more storage lockers 101 is available to be accessed. For example, the control unit 103 consults a database that may be locally or remotely managed and/or located in which usage information about the storage lockers 101 is stored to determine which of the storage lockers 101 are available for rental and which storage lockers 101 are currently rented.

The control unit 103, upon determining which storage lockers 101 are available, causes, at least in part, an accessibility report to be displayed on the user interface 107 based, at least in part, on the request to access at least one of the one or more storage lockers 101. The accessibility report includes an indication of which of the one or more storage lockers 101 is determined to be available to be accessed. The accessibility report may, for example, be any combination of a graphical display of the storage locker 101 layout in any of a two-dimensional or three-dimensional graphical display, or a list of storage lockers 101 indicating only available storage lockers 101, or indicating the status of all available and unavailable storage lockers 101, for example. In some embodiments, the user interface 107 may provide options such as display only available storage lockers 101, display all storage lockers 101, display storage lockers in this region of the system 100, display storage lockers 101 near me or my intended destination, display storage lockers 101 and their respective availabilities at another system 100, display availability indications of small, medium or large storage lockers, or any combination thereof.

In some embodiments, the accessibility report may also include time remaining with respect to particular already rented unavailable storage lockers 101 so that the user may anticipate when a particular storage locker 101 may become available for access. For example, if the system 100 does not have any large storage lockers 101 available, and the user requires a large storage locker 101, then the user may want to wait for such a storage locker to become available, or return at the anticipated time that one might become available. In some embodiments, the user interface 107 may include an option alert a user by sending the user a message that indicates when a particular storage locker 101 becomes available so that the user may request access to and/or reserve that particular storage locker 101 when it becomes available. Such messages may be sent to a device associated with the user by way of text message, multimedia message, email, phone call, or specific storage locker rental application that may be accessible using the device associated with the user.

If a desirable storage locker 101 is indeed available, the user may select which of the storage lockers 101 the user would like to rent by way of the user interface 107. For example, the user interface 107 may enable a two-dimensional or three-dimensional graphical illustration of the storage lockers 101 to be selected by touching the user interface 107, which may for example, highlight the selected storage locker 101. Similarly, in the case of a list of available storage lockers 101, or list that indicates the status of one or more of the storage lockers 101, a line item referring to a selected storage locker 101 may be highlighted as the control unit 103 processes the selection. Alternatively, a selection of a particular storage locker 101 may cause the user interface 107 to advance to another screen as the control unit 103, accordingly, processes the selection.

In either case, one a selection is made with regard to a particular determined available storage locker 101, the control unit 103 enables an access or rental duration to be selected. The duration of access or rental may be for a selected time period such as a period of hours, minutes, etc., or a particular time of day at which the rental period is to expire. An appropriate fee is charged by the system 100 based, at least in part, on any combination of rental duration, size of locker, time of day, day of the week, month, location, etc. One the access duration is selected and agreed upon, the control unit 103 enables a financial transaction associated with paying for the requested storage locker 101 rental to occur. For example, the control unit 103 may be configured to accept any combination of a credit card payment, cash, payment from a user account associated with the storage locker rental system 100, other forms of electronic payment, payment by user equipment such as a phone or mobile device, etc. The control unit 103 may be configured to confirm the funds associated with the financial transaction itself, or the control unit 103 may be configured to communicate with a storage locker access management system to confirm the funds associated with the financial transaction.

Upon confirmation of a completed financial transaction to pay for the storage locker 101 for the designated duration of a rental period, the control unit 103 causes, at least in part, an access message to be generated and communicated. The access message includes the selected storage locker 101 number, an access code to enable access to the selected storage locker 101, and a duration of access indication of the selected available storage locker 101. In embodiments, the access message may be communicated using any combination of a display on the user interface 107, print out onto a paper or other substrate using printing unit 109, text message, multimedia message, email, phone call, or other message associated with a specific storage locker rental application accessible by way of a device associated with the user, etc. In one or more embodiments, the access code is generated by a random number generator as instructed by the control unit 103.

The control unit 103 also causes, at least in part, the lock instruction, discussed above, to be communicated to the electronic locking mechanism 135 associated with the selected storage locker 101. The lock instruction may be any of and instruction to lock or unlock the door portion 127 by causing the electronic locking mechanism 135 to be in the locked or unlocked status. In some embodiments, the control unit 103 may cause the electronic locking mechanism 135 to be in the locked or unlocked status upon entry of a verifiable access code provided by way of the access message, or the control unit 103 may cause the electronic locking mechanism 135 to be in the locked or unlocked status based on an access authorization indicator.

For example, an access authorization indicator may be associated with one or more of a financial transaction associated with use of the at least one storage locker or a management system operator input. In some embodiments, the storage lockers 101, regardless of availability, may have a default condition that causes the electronic locking mechanisms to be in the locked status unless an access authorization indicator is communicated or an access code is verified. Upon confirmation of payment for the storage locker 101 rental, the control unit 103 may communicate a lock instruction to cause the electronic locking mechanism 135 to be in the unlocked status, at least until the access code is input and verified, thereby causing the electronic locking mechanism 135 to be in the locked status. Alternatively, an access authorization indicator may be sourced from a storage locker access management system or otherwise authorized system administrator to cause the control unit 103 to communicate a lock instruction that causes the electronic locking mechanism 135 to be in the unlocked status on demand.

In some embodiments, the control unit 103 is positioned remote from the one or more storage lockers 101 and housed in the control unit housing 105. The control unit housing 105 is therefore also configured to support the user interface 107 and any display associated therewith as well as the printing unit 109. If positioned remote from the one or more storage lockers 101, the control unit 103 is configured to wirelessly communicate with the one or more electronic locking mechanisms 135, either directly or indirectly, and optionally a storage locker access management system (discussed below) by way of a wireless communication network.

The system 100, as discussed above, may also include one or more input interfaces 111 that are configured to receive a user input associated with the access code. The input interfaces 111 may be positioned on the door portion 127, or the input interfaces 111 may be associated with a user device such that when an access code is input and verified, the electronic locking mechanism 135 is caused to be in the locked or unlocked status based on a received lock instruction, and/or based on a proximity of the user device to the electronic locking mechanism 135, for example.

In some embodiments, to enable entry of the access code, the input interface 111 may comprise a touch screen keypad, a raised button keypad, etc., configured to receive a manually input access code. The input interface 111 may include any number of keys on its keypad. In some embodiments the input interface 111 may include four keys corresponding to available numbers for inputting the access code, but in other embodiments, the input interface 111 may include a few at two keys in which a sequence of first button and second button entries may be input as the access code, and as many as 10 keys such as a type of keypad that corresponds to a conventional telephone keypad to enable a more complex access code to be used. It should be noted, however, that there is no limit to the number of keys the input interface 111 may include.

In some embodiments, the input interface 111 may include, for example, four keys. But, upon entry of a first number, letter, or symbol of the access code, the keys may refresh to display a different combination of key options to select for entry of the second number of an access code, and so on. For example, if the access code is "1, #, 6, $," a first keypad presented by input interface 111 may include "1, 5, 4, *" from which the user must select a character. Then, upon entry of a first character, the input interface 111 may refresh to display "1, &, #, 9." Then, upon selection of a next character, the input interface 111 may refresh to display "9, 6, 2, %." Then, upon entry of a third character, the input interface 111 may refresh the display "8, @, $, 4." Lastly, upon entry of the fourth symbol at the input interface 111, if the correct access code sequence was entered and verified, the lock instruction may be sent to the electronic locking mechanism 135 to lock or unlock the electronic locking mechanism 135. If an improper access code is input, then the electronic locking mechanism 135 will remain in its current locked or unlocked status.

In some embodiments, the input interface 111 may also include an electronic locking mechanism status indicator, discussed below, configured to indicate the electronic locking mechanism 135 is in the locked or unlocked status. For example, a green light may indicate unlocked and a red light may indicate locked. Or, an indication on the input interface 111 may simply state locked or unlocked, for example.

According to various embodiments, the at least one memory and the computer program code are further configured to, with the at least one processor, cause the access code input at the input interface 111 to be verified based, at least in part, on one or more of the lock instruction and a verification communication with the control unit 103 that compares the user input with the issued access code. In some embodiments, the lock instruction, accordingly, may include data associated with verifying the access code. For example, in some embodiments, the lock instruction is stored in another memory associated with the one or more electronic locking mechanisms 135. Verification of the access code may therefore be based, at least in part, on the lock instruction stored in the another memory associated with the electronic locking mechanism 135 so that a verification communication need not be sent to the control unit 103 in order to enable access code verification.

According to various embodiments, alternatively or in addition to the control unit 103, the input interfaces 111 may themselves serve as individual control units 103 comprising respective user interfaces 107. In other words, each storage locker 101 may include its own respective control unit 103 positioned on the door portion 127. The user interfaces 107, in this embodiment, are also configured to facilitate the access request, the financial transaction associated with use of the selected available storage locker 101, and the communication of the access message. The user interfaces 107, in this embodiment, themselves also comprise a touch screen keypad configured to receive a manually input access code. Similarly, in this embodiment, the one or more control units 103 are configured to communicate with the one or more electronic locking mechanisms 135 and optionally a storage locker access management system positioned remote from the one or more control units 103. Any communication between such a storage locker access management system and the control units 103 is accordingly by way of a wireless communication network.

In some embodiments, the control unit 103 may include a customer service user interface accessible by way of the user interface 107 by which a user may communicate with a system administrator regarding usage of the system 100. The system 100 may also include the video camera 121 discussed above to enable the system administrator to view the present status of the system 100 and/or the user requesting customer service. The video camera 121 may also be configured to provide security footage for the system 100 and surrounding area. In some embodiments, the video camera 121 is configured to wirelessly communicate imagery directly to a storage locker management system associated with the system 100. In other embodiments, the video camera 121 is configured to wirelessly communicate imagery to a storage locker management system associated with the system 100 by way of the control unit 103. If communicated by way of the control unit 103, the video camera 121 may one or more of communicate with the control unit 103 by way of wired communication or wireless communication.

As discussed above, the system 100 also includes the display portion 123. The display portion 123 is configured to be in communication with a storage locker access management system associated with the system 100. The display portion 123 is configured to display one or more images in accordance with a display instruction received from the storage locker access management system by way of a wireless communication network either directly or indirectly. For example, the display instruction may be received directly from the storage locker access management system, or it may be received by way of the control unit 103.

According to various embodiments, the display portion 123 may be configured to display any combination of images including, but not limited to, constant images that use the entire display portion 123 or one or more portions of the display portion 123 such as advertisements or messages that are instructed to be displayed by the storage locker access management system. Such images may be continually displayed until a change is directed or requested, or the images may changes based on a predefined schedule, for example. In some embodiments, the images displayed may vary in size and orientation on the display portion 123, and the display portion 123 may be caused to act as a split screen based on the instructed imagery that is to be displayed.

According to various embodiments, the storage locker access management system with which the system 100 is associated may be configured to develop a user profile associated with one or more users of the system 100 and/or be in communication with a third party service such as a social networking service, for example. Accordingly, the images that are instructed to be displayed by the display portion 123 may be caused to change based, at least in part, on a correspondence with a user's interests. A user's interests may be determined based on a developed user profile that is stored and managed by the storage locker access management system or the system 100, for example, or based on any information that may be available by way of the social networking service with which the system 100 may directly or indirectly communicate by way of the storage locker access management system.

If imagery displayed by the display portion 123 is associated with a user's interests, any changes in the imagery may be caused by a determined proximity of a user device to the system 100 and/or a determination that a particular user that is in the process of renting a storage locker 101, for example. If based on the proximity of the user device, the user may not even be associated with the system 100, but rather solely associated with the social networking service, for example.

The display portion 123 may also be configured to display usage instructions continually, or on demand using all or a portion of the display portion 123. Such usage instructions, if displayed on demand, may be presented based on a recent rental occurrence, a currently processing rental transaction, toggling of a button or user interface option to display such information, or if a determination is made by the control unit 103 that an unverifiable access code has been input and the user might be having some difficulty using the system 100 such as being unable to lock or unlock the storage locker 101.

In one or more embodiments, the display portion 123 may be configured to illustrate a regional map associated with a location at which the system 100 is deployed. The regional map may be presented based, for example, on a determined position of the system 100 based, at least in part, on a communication between the control unit 103 with the storage locker access management system associated with the system 100, an internal GPS unit, a communication with a wireless network service provider, etc. In some embodiments, if public transportation is readily available, the display portion 123 may also be configured to illustrate public transportation schedules on demand if configured to communicate with a third party transportation provider, for example.

According to one or more embodiments, the display portion 123 may comprise any number of displays that may include any combination of LCD panels, LED panels, projection displays, CRT displays, plasma displays, OLED displays, etc. In some embodiments, the door portions 127 of the storage lockers 101 may be themselves a series of display portions 123, or comprise a series of display portions 123, that may individually or jointly provide imagery as instructed and discussed above.

According to various embodiments, the system 100 is a self sustaining solar powered storage locker rental system that need not be positioned near any external power source. To enable this energy independence, the system 100 includes at least one solar energy collection unit 117 configured to collect solar energy. The one or more solar energy collection units 117 may be positioned, for example, on any portion of the canopy portion 113 such as the front, back, right side, left side, top, or the canopy portion 113 may be entirely made up of solar energy collection units 117. In addition to providing a surface for collecting solar power, the canopy portion 113 also protects the storage lockers 101, the control unit 103, and/or the display portion 123 from environmental elements such as rain, wind, and sunlight.

The system 100, as discussed above, also includes one or more energy storage units 119 configured to store the collected solar energy and supply power to the system 100. According to various embodiments, the energy storage units 119 may include any number of rechargeable batteries or capacitors of any type such as, but not limited to, any combination of lithium batteries, lithium-ion batteries, lithium-ion polymer batteries, alkaline batteries, nickel-cadmium batteries, organic batteries, polymer-based batteries, nickel-metal hydride batteries, lithium sulfur batteries, thin film batteries, smart batteries, carbon foam-based lead acid batteries, potassium-ion batteries, sodium-ion batteries, nanowire batteries, thin-film/solar cell batteries, ceramic batteries, solar capacitors, solar super capacitors, etc.

In some embodiments, the energy storage units 119 are accommodated in the control unit housing 105. But, in other embodiments, the energy storage units 119 may additionally or alternatively be accommodated within their own individual housing that may be similar to the illustrated control unit housing 105, within the base member 125, the canopy support members 115, and/or the canopy portion 113. If the energy storage units 119 are of a thin-film solar cell battery type, the energy storage units 119 may accordingly be accommodated, as a part of or atop the canopy portion 113, for example.

In one or more embodiments, at least one of the one or more canopy support members 115 is configured to have a channel within which one or more wires are run. The one or more wires that run within the canopy support members 115 are configured to operatively connect the at least one solar energy collection unit 117 to the energy storage unit 119 and/or the energy storage unit 119 to the control unit 103. In some embodiments, one or more of the canopy support members 115 may be configured to co-operate with one or more motors or pneumatic systems that are internal to the canopy support members 115 to adjust a height and/or angular orientation of the canopy portion 113 based, at least in part, on a time of day, schedule, deployment location of the system 100, or on demand. For example, if the sun is setting, the control unit 103 may cause the canopy portion 113 to be tilted in a direction associated with the setting sun to optimize solar energy collection.

According to various embodiments, the base member 125 is configured to support the one or more storage lockers 101, the canopy portion 113, the one or more canopy support members 115, and the control unit housing 105. For example, the entire system 100 may moved unitarily from one position to another because the system 100 is entirely supported by the base member 125. The one or more storage lockers 101 are configured to be waterproof when the door portion 127 is in the closed position and the electronic locking mechanism 135 is in the locked status. Similarly, the control unit housing 105, and any other housing associated with the energy storage unit 119, is also configured to be waterproof.

To further enhance the water resistance of the system 100, the base member 125 is configured to elevate the storage lockers 101 and/or the control unit housing 105 from a ground surface upon which the system 100 is placed. For example, the base member 125 may cause the system storage lockers 101 and the control unit housing 105 to be elevated anywhere from two inches to 24 inches above ground level. Such an elevation may prevent water from entering the storage lockers 101, for example. In some embodiments, the base member 125 may also be outfitted with one or more drain portions 137 and optionally sloped to cause water to run away from the storage lockers 101 toward the drain portions 137. The drain portions 137 may be configured to collect water that is present on the surface of the base member 125 and enable the water to be directed away from the storage lockers 101 toward an area of the ground surface that is away from a region in which a determined majority of foot traffic exists. For example, in some embodiments, the base member 125 may include one or more outlets 139 that may be optionally opened or closed to direct water collected by the drain portions 137 to be output from the system 100 in a particular direction.

In one or more embodiments, the storage lockers 101 may be configured to include a light source 141 configured to illuminate the cavity or inside portion of the storage locker 101 when the door portion 127 is in the open position. Such light sources may be any form of light source such as, but not limited to, an LED light, an LCD panel, a fluorescent light, an incandescent bulb, etc.

Figure 2:
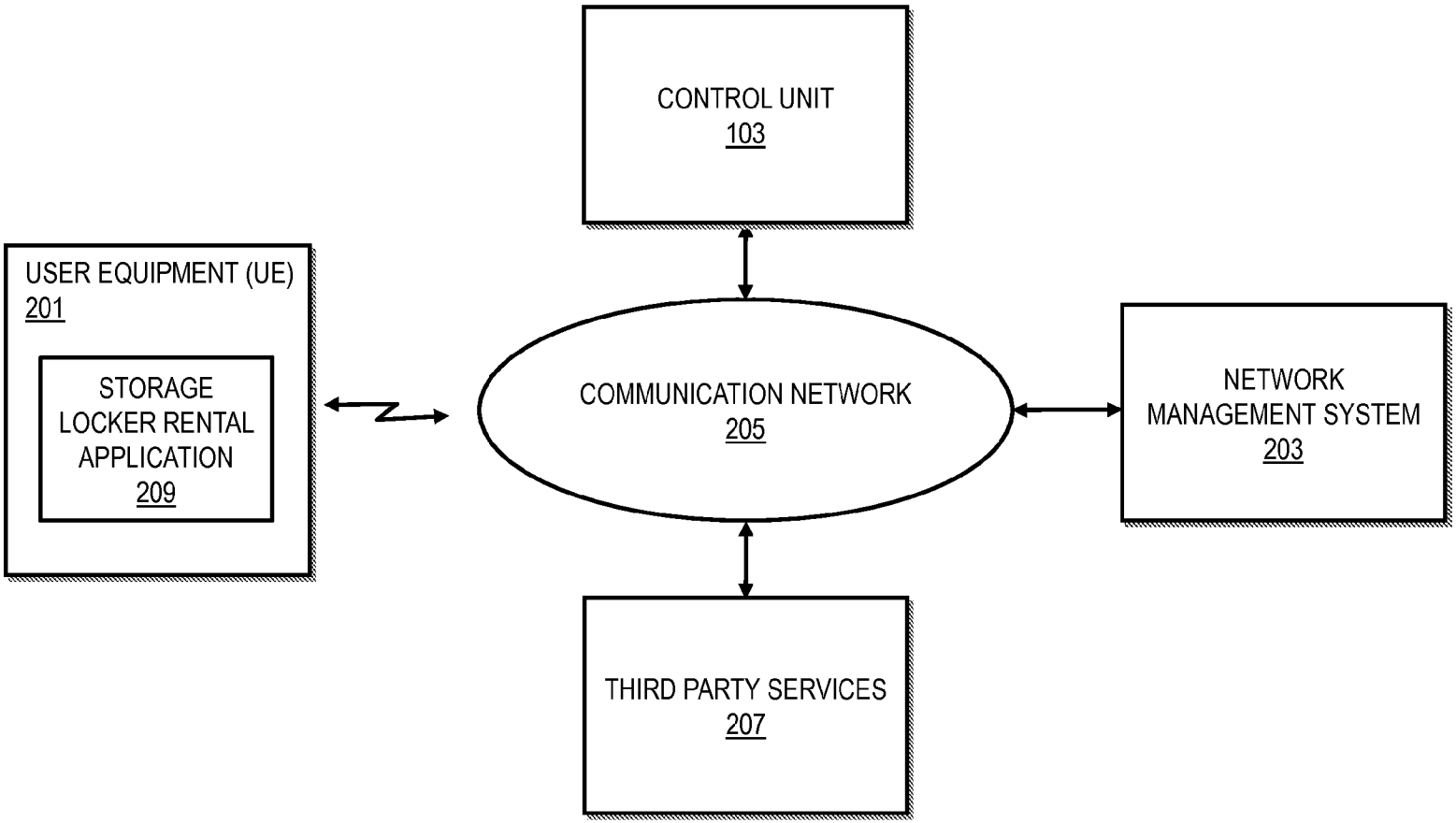
FIG. 2 is a diagram of a communication network associated with a self sustaining solar powered storage locker rental system, according to one embodiment.

FIG. 2 illustrates a communication network associated with a self sustaining solar powered storage locker rental system. The control unit 103 of the system 100 communicates with a user device as discussed above such as user equipment (UE) 201, a storage locker access management system 203 associated with remote management and control of the system 100, as well as any third party application services 207 such as, but not limited to, various social networking services, public transportation services, wireless carrier services, local entertainment services, etc. The UE 201, control unit 103, storage locker access management system 203, and third party services 207 have connectivity to one another via a communication network 205.

By way of example, while the various components of the system 100 such as the control unit 103, input interfaces 111, and video camera 121 may themselves communicated wirelessly to one another and/or with the storage locker access management system 203 through wireless communication networks or channels that may be discussed in greater detail below as various example forms of wireless communications, communications between the UE 201, storage locker access management system 203, and any third party services 207 may not be so limited.

Accordingly, communication network 205 includes one or more networks such as a wired data network, a wireless network, a telephony network, or any combination thereof. It is contemplated that the data network may be any local area network (LAN), metropolitan area network (MAN), wide area network (WAN), a public data network (e.g., the Internet), short range wireless network, or any other suitable packet-switched network, such as a commercially owned, proprietary packet-switched network, e.g., a proprietary cable or fiber-optic network, and the like, or any combination thereof. In addition, the wireless network may be, for example, a cellular network and may employ various technologies including enhanced data rates for global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., worldwide interoperability for microwave access (WiMAX), Long Term Evolution (LTE) networks, code division multiple access (CDMA), wideband code division multiple access (WCDMA), wireless fidelity (WiFi), WiGig, wireless LAN (WLAN), Bluetooth®, Internet Protocol (IP) data casting, satellite, mobile ad-hoc network (MANET), and the like, or any combination thereof.

The UE 201 is any type of mobile terminal, fixed terminal, or portable terminal including a mobile handset, station, unit, device, multimedia computer, multimedia tablet, Internet node, communicator, desktop computer, laptop computer, notebook computer, netbook computer, tablet computer, personal communication system (PCS) device, personal navigation device, personal digital assistants (PDAs), audio/video player, digital camera/camcorder, positioning device, television receiver, radio broadcast receiver, electronic book device, game device, or any combination thereof, including the accessories and peripherals of these devices, or any combination thereof. It is also contemplated that the UE 201 can support any type of interface to the user (such as "wearable" circuitry, etc.).

According to various embodiments, a user may initiate a storage locker 101 rental using any of the control unit 103 or the UE 201. If initiated using the UE 201, the UE 201 may be configured to enable access to a storage locker rental application 209 associated with the usage of the system 100. Any request to access a storage locker 101 may be processed independently by the control unit 103, or may be communicated to the storage locker access management system 203. For example, financial transactions may be communicated to the storage locker access management system 203 for processing and authorization with a credit card company, bank, or other financial institution. Upon authorization confirmation, the storage locker access management system 203 may authorize the control unit 103 to proceed with the storage locker rental process, as discussed above. Alternatively, the control unit 103 may be capable of conducting such a transaction independently and may simply report the outcome of a transaction to the storage locker access management system 203.

A system administrator may also manage one or more system 100's remotely by way of the storage locker access management system 203, for example, to enable access to a storage locker 101, monitor operating conditions of the system 100 including, but not limited to, activity, usage, volume, availability, profitability, safety, location, power usage, power availability, etc. Further, customer support for users of the system 100 may be handled by an administrator having access to the storage locker access management system 203. In embodiments, an instruction with respect to what is to be displayed by the display portion 123 may be sourced by the storage locker access management system 203. In some embodiments, a user may request that a particular message or image be displayed at a particular time, randomly, or on demand, by way of the storage locker rental application 209 or control unit 103, for example, for a fee. In some instances, messages or images may need to be approved by an administrator having access to the storage locker access management system 203, or controls may be enabled by the storage locker access management system 203 to screen what types of messages and/or images may be displayed without approval.

According to various embodiments, the system 100, as discussed above may provide storage lockers 101 of different sizes. A large storage locker 101 would have length and width dimensions larger than a medium-sized storage locker 101 which accordingly would have length and width dimensions larger than a small-sized storage locker 101. The storage locker access management system 203 may be configured to determine which sized lockers may be provided by a particular system 100 and which sized lockers are available. The storage locker access management system 203 may, in some embodiments, cause pricing variations based on particular storage locker 101 sizes, availability, times, duration of rental, etc. In some embodiments, the storage locker access management system 203 causes a message to be communicated to the UE 201 to alert a user that a particular locker is available, a particular price point or sale may be occurring or about to occur, or that a user's paid rental time is about to expire.

In one or more embodiments, the storage locker access management system 203 may be configured to cause additional fees to be charged if a storage locker 101 rental is determined to have extended beyond a predetermined duration associated with a first confirmed financial transaction. If a storage locker 101 rental period extends beyond the pre-paid duration, the storage locker access management system 203 may be configured to continually charge the user by continually causing one or more additional financial transactions at predefined intervals for particular predetermined amounts. For example, if a user pays for a storage locker 101 rental that is to last for four hours, but does not terminate the storage locker 101 rental on time, the storage locker access management system 203 may cause additional fees to be charged for extended rental services by the minute, 5 minutes, 10 minutes, 15 minutes, 20 minutes, half-hour, or whole hour, based on a predefined setting for example.

In some embodiments, if a storage locker 101 rental is initiated, and the rental service is not terminated by the pre-paid duration, and a next financial transaction is declined, the storage locker access management system 203 may reset the access code to thereby detain any contents of the selected storage locker 101 until such fees are paid or an administrator allows access via an access authorization instruction to the electronic locking mechanism 135 of the particular storage locker 101 at issue.

By way of example, the UE 201, control unit 103, storage locker access management system 203, and third party services 207 communicate with each other and other components of the communication network 205 using well known, new or still developing protocols. In this context, a protocol includes a set of rules defining how the network nodes within the communication network 205 interact with each other based on information sent over the communication links. The protocols are effective at different layers of operation within each node, from generating and receiving physical signals of various types, to selecting a link for transferring those signals, to the format of information indicated by those signals, to identifying which software application executing on a computer system sends or receives the information. The conceptually different layers of protocols for exchanging information over a network are described in the Open Systems Interconnection (OSI) Reference Model.

Communications between the network nodes are typically effected by exchanging discrete packets of data. Each packet typically comprises (1) header information associated with a particular protocol, and (2) payload information that follows the header information and contains information that may be processed independently of that particular protocol. In some protocols, the packet includes (3) trailer information following the payload and indicating the end of the payload information. The header includes information such as the source of the packet, its destination, the length of the payload, and other properties used by the protocol. Often, the data in the payload for the particular protocol includes a header and payload for a different protocol associated with a different, higher layer of the OSI Reference Model. The header for a particular protocol typically indicates a type for the next protocol contained in its payload. The higher layer protocol is said to be encapsulated in the lower layer protocol. The headers included in a packet traversing multiple heterogeneous networks, such as the Internet, typically include a physical (layer 1) header, a data-link (layer 2) header, an internetwork (layer 3) header and a transport (layer 4) header, and various application (layer 5, layer 6 and layer 7) headers as defined by the OSI Reference Model.

Figure 3:
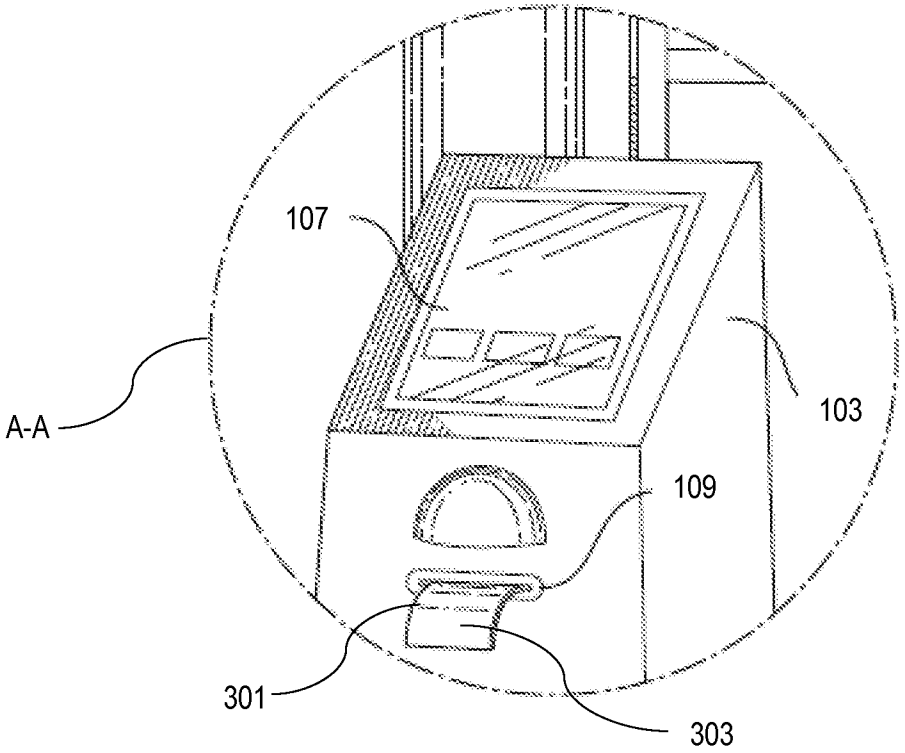
FIG. 3. is a diagram of a control unit associated with a self sustaining solar powered storage locker rental system, according to one embodiment.

FIG. 3 is a close-up view A-A of control unit 103, discussed above and illustrated in FIG. 1. The control unit 103 includes the user interface 107 and printing unit 109 configured to apply the access message 301 onto a substrate 303. As discussed above, the access message 301 may additionally or alternatively be communicated by way of the user interface 107 and/or the UE 201.

Figure 4:
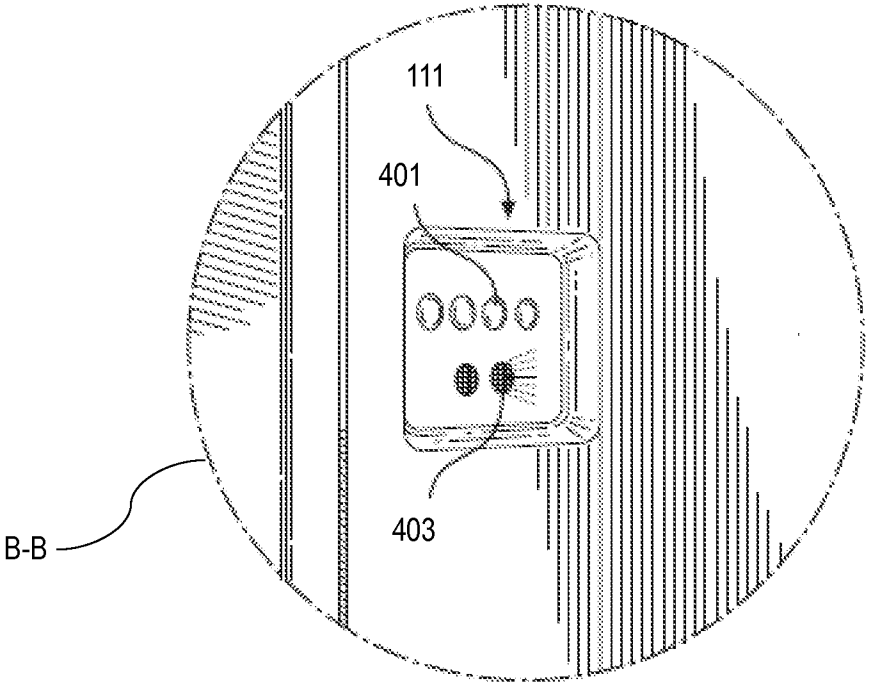
FIG. 4 is a diagram of an input interface configured to receive a user input such as an access code; according to one embodiment.

FIG. 4 is a close-up view B-B of an input interface 111, discussed above and illustrated in FIG. 1. The input interface 111 includes the keypad 401 which is illustrated as having four keys. The keypad 401, as discussed above, may have any number of fixed or variable keys, however. The keypad 401 may be any of a touch screen-type or physical key-type such as button-based including or excluding brail features. The input interface 111 may also include the illustrated electronic locking mechanism status indicator 403 to indicate whether the electronic locking mechanism is in the locked or unlocked status. As discussed above, the input interface 111 may be in addition to or as an alternative of a control unit 103 that may be positioned on each of the door portions 127 of the storage lockers 101.

Figure 5:
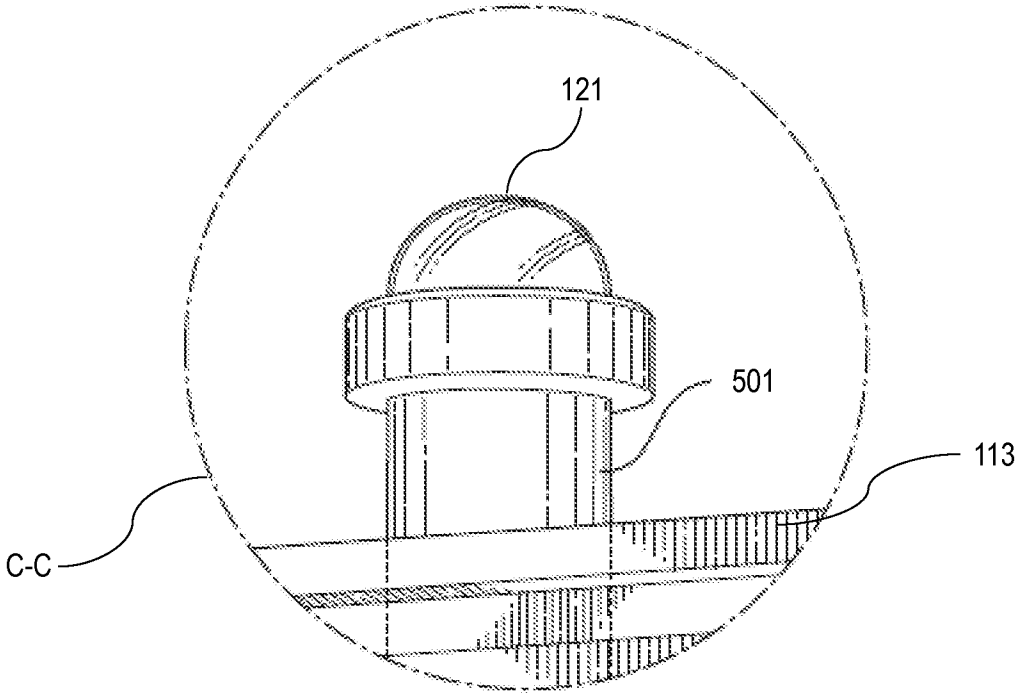
FIG. 5 is a diagram of a camera configured to wirelessly transmit imagery to a storage locker access management system, according to one embodiment.

FIG. 5 is a close-up view C-C of video camera 121, discussed above and illustrated in FIG. 1. The video camera 121 is positioned above the canopy portion 113. The video camera 121 is elevated above the canopy by a camera support 501. In some embodiments, the camera support 501 may be configured to be adjustable on demand based on an instruction provided by the storage locker access management system, discussed above.

Figure 6:
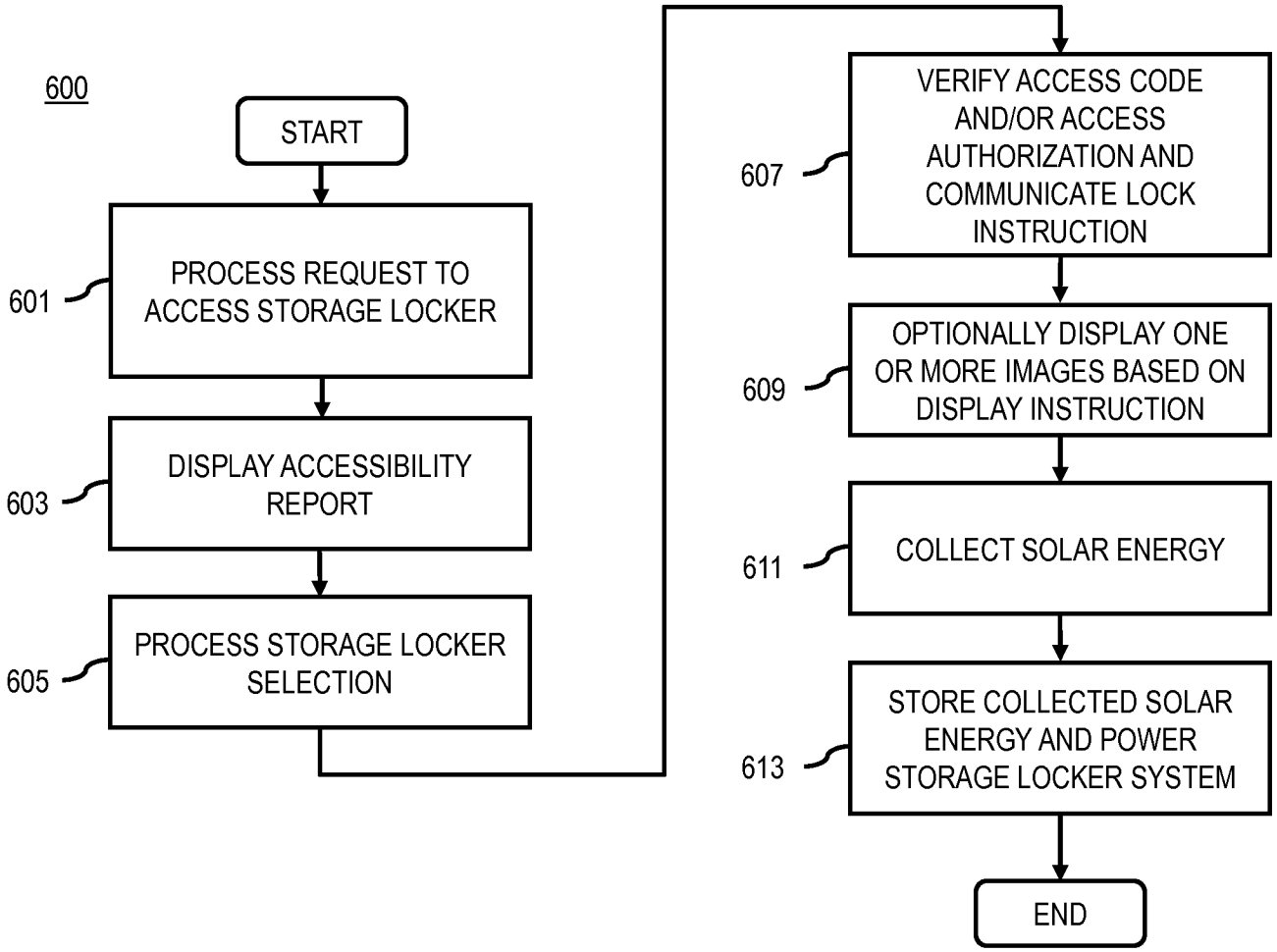
FIG. 6 is a flowchart of a process for providing storage space rental services from a self sustaining solar powered storage locker rental system that may be remotely monitored and controlled, according to one embodiment.
Figure 7:
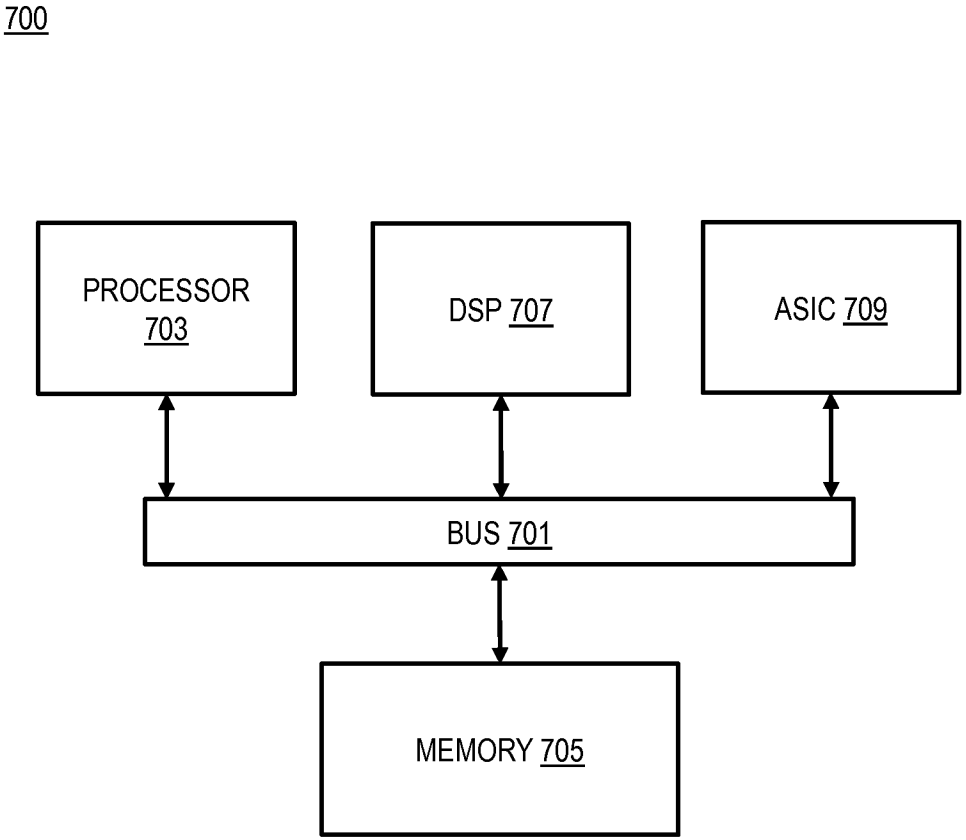
FIG. 7 is a diagram of a chip set that can be used to implement an embodiment.

FIG. 6 is a flowchart of a process for providing storage space rental services from a self sustaining solar powered storage locker rental system that may be remotely monitored and controlled, according to one embodiment. In one embodiment, one or more of the control unit 103 and the storage locker access management system 203 performs the process 600 by way of a control platform implemented in, for instance, a chip set including a processor and a memory as shown in FIG. 7. In step 601, the control platform processes a request to access at least one storage locker that is among one or more storage lockers associated with a storage locker rental apparatus to determine at least one of the one or more storage lockers is available to be accessed. Then, in step 603, the control platform causes, at least in part, an accessibility report to be displayed on a user interface based, at least in part, on the request to access at least one of the one or more storage lockers. The accessibility report including an indication of which of the one or more storage lockers is determined to be available to be accessed.

Next, in step 605, the control platform processes a selection associated with a particular determined available storage locker to cause, at least in part, an access message to be generated and communicated based, at least in part, on a confirmed financial transaction. The access message comprises a locker number, an access code, and a duration of access indication of the selected available storage locker. In one or more embodiments, as discussed above, the access message may be communicated by way of electronic or printed means such as by way of a user device, the control unit, and/or a printing unit configured to apply the access message to a substrate and output the printed substrate from the control unit. In some embodiments, as discussed above, the access code is generated by a random number generator.

The process continues to step 607 in which the control platform causes, at least in part, the lock instruction to be communicated to an electronic locking mechanism based, at least in part, on one or more of a reception of the access code and an access authorization indicator, the access authorization indicator being associated with one or more of the confirmed financial transaction associated with use of the at least one storage locker or a management system operator input.

The control platform causes, at least in part, an input access code to be verified based, at least in part, on a communication between a control unit configured to facilitate the access request, the financial transaction associated with use of the at least one storage locker, and the communication of the access message, and an input interface configured to receive a user input associated with the access code. The input interface may be available by way of a separate display, or merely a different graphical user interface made available by way of a same display. The control unit is configured to communicate with the one or more electronic locking mechanisms and a storage locker access management system positioned remote from the control unit. The communication between the storage locker access management system is by way of a wireless communication network. If the access code is verified, then a lock instruction to change the electronic locking mechanism status to locked or unlocked is communicated to the electronic locking mechanism The process continues to step 609 in which the control platform optionally causes, at least in part, a display portion in communication with the storage locker access management system, to display one or more images in accordance with a display instruction received from a storage locker access management system by way of the wireless communication network.

Then, in step 611, the control platform causes, at least in part, solar energy to be collected by at least one solar energy collection unit configured to collect solar energy. Next, in step 613, the control platform causes the collected solar energy to be stored by an energy storage unit configured to store the collected solar energy and power to be supplied to the storage locker rental apparatus from the energy storage unit.

The processes described herein for providing storage space rental services from a self sustaining solar powered storage locker rental system that may be remotely monitored and controlled may be advantageously implemented via software, hardware, firmware or a combination of software and/or firmware and/or hardware. For example, the processes described herein, may be advantageously implemented via processor(s), Digital Signal Processing (DSP) chip, an Application Specific Integrated Circuit (ASIC), Field Programmable Gate Arrays (FPGAs), etc. Such exemplary hardware for performing the described functions is detailed below.

FIG. 7 illustrates a chip set or chip 700 upon which an embodiment may be implemented. Chip set 700 is programmed to provide storage space rental services from a self sustaining solar powered storage locker rental system that may be remotely monitored and controlled as described herein may include, for example, bus 701, processor 703, memory 705, DSP 707 and ASIC 709 components.

The processor 703 and memory 705 may be incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 700 can be implemented in a single chip. It is further contemplated that in certain embodiments the chip set or chip 700 can be implemented as a single "system on a chip." It is further contemplated that in certain embodiments a separate ASIC would not be used, for example, and that all relevant functions as disclosed herein would be performed by a processor or processors. Chip set or chip 700, or a portion thereof, constitutes a means for performing one or more steps of providing storage space rental services from a self sustaining solar powered storage locker rental system that may be remotely monitored and controlled.

In one or more embodiments, the chip set or chip 700 includes a communication mechanism such as bus 701 for passing information among the components of the chip set 700. Processor 703 has connectivity to the bus 701 to execute instructions and process information stored in, for example, a memory 705. The processor 703 may include one or more processing cores with each core configured to perform independently. A multi-core processor enables multiprocessing within a single physical package. Examples of a multi-core processor include two, four, eight, or greater numbers of processing cores. Alternatively or in addition, the processor 703 may include one or more microprocessors configured in tandem via the bus 701 to enable independent execution of instructions, pipelining, and multithreading. The processor 703 may also be accompanied with one or more specialized components to perform certain processing functions and tasks such as one or more digital signal processors (DSP) 707, or one or more application-specific integrated circuits (ASIC) 709. A DSP 707 typically is configured to process real-world signals (e.g., sound) in real time independently of the processor 703. Similarly, an ASIC 709 can be configured to performed specialized functions not easily performed by a more general purpose processor. Other specialized components to aid in performing the functions described herein may include one or more field programmable gate arrays (FPGA), one or more controllers, or one or more other special-purpose computer chips.

In one or more embodiments, the processor (or multiple processors) 703 performs a set of operations on information as specified by computer program code related to providing storage space rental services from a self sustaining solar powered storage locker rental system that may be remotely monitored and controlled. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 701 and placing information on the bus 701. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 703, such as a sequence of operation codes, constitute processor instructions, also called computer system instructions or, simply, computer instructions. Processors may be implemented as mechanical, electrical, magnetic, optical, chemical or quantum components, among others, alone or in combination.

The processor 703 and accompanying components have connectivity to the memory 705 via the bus 701. The memory 705 may include one or more of dynamic memory (e.g., RAM, magnetic disk, writable optical disk, etc.) and static memory (e.g., ROM, CD-ROM, etc.) for storing executable instructions that when executed perform the steps described herein to provide storage space rental services from a self sustaining solar powered storage locker rental system that may be remotely monitored and controlled. The memory 705 also stores the data associated with or generated by the execution of the steps.

In one or more embodiments, the memory 705, such as a random access memory (RAM) or any other dynamic storage device, stores information including processor instructions for providing storage space rental services from a self sustaining solar powered storage locker rental system that may be remotely monitored and controlled. Dynamic memory allows information stored therein to be changed by the system 100. RAM allows a unit of information stored at a location called a memory address to be stored and retrieved independently of information at neighboring addresses. The memory 705 is also used by the processor 703 to store temporary values during execution of processor instructions. The memory 705 may also be a read only memory (ROM) or any other static storage device coupled to the bus 701 for storing static information, including instructions, that is not changed by the system 100. Some memory is composed of volatile storage that loses the information stored thereon when power is lost. The memory 705 may also be a non-volatile (persistent) storage device, such as a magnetic disk, optical disk or flash card, for storing information, including instructions, that persists even when the system 100 is turned off or otherwise loses power.

The term "computer-readable medium" as used herein refers to any medium that participates in providing information to processor 703, including instructions for execution. Such a medium may take many forms, including, but not limited to computer-readable storage medium (e.g., non-volatile media, volatile media), and transmission media. Non-volatile media includes, for example, optical or magnetic disks. Volatile media include, for example, dynamic memory. Transmission media include, for example, twisted pair cables, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, an EEPROM, a flash memory, any other memory chip or cartridge, a carrier wave, or any other medium from which a computer can read. The term computer-readable storage medium is used herein to refer to any computer-readable medium except transmission media.

While a number of embodiments and implementations have been described, the disclosure is not so limited but covers various obvious modifications and equivalent arrangements, which fall within the purview of the appended claims. Although features of various embodiments are expressed in certain combinations among the claims, it is contemplated that these features can be arranged in any combination and order.

What is claimed is:

1. An apparatus comprising:

a plurality of storage lockers configured to store one or more items, the storage lockers of the plurality of storage lockers each comprising:

a top portion;

a bottom portion distal the top portion;

a first side portion having a first side portion length extending from the top portion to the bottom portion;

a second side portion distal the first side portion having a second side portion length extending from the top portion to the bottom portion;

a rear portion having a rear portion length extending from the top portion to the bottom portion and a rear portion width extending from the first side portion to the second side portion, the top portion, bottom portion, first side portion, second side portion, and rear portion being arranged to form a cavity therebetween, the cavity having an opening distal the rear portion;

a door portion adjoined to the first side portion by at least one hinge, the door portion being configured to move between an open position and a closed position, the door portion further being configured to engage a door stop associated with the second side portion when the door portion is in the closed position, thereby sealing the opening; and an electronic locking mechanism configured to be in one of a locked or an unlocked status and to cause the door portion to also be one of locked or unlocked when the door portion is in the closed position based, at least in part, on a lock instruction;

at least one processor;

at least one memory including computer program code for one or more programs, the at least one memory and the computer program code configured to, with the at least one processor, cause the apparatus to:

process a request to access at least one of the storage lockers of the plurality of storage lockers to determine at least one of the storage lockers of the plurality of storage lockers is available to be accessed;

cause, at least in part, an accessibility report to be displayed on a user interface based, at least in part, on the request to access at least one of the storage lockers of the plurality of storage lockers, the accessibility report including an indication of which of the storage lockers of the plurality of storage lockers is determined to be available to be accessed;

process a selection associated with a particular determined available storage locker of the plurality of storage lockers to cause, at least in part, an access message to be generated and communicated based, at least in part, on a confirmed financial transaction, the access message comprising a locker number, an access code, and a duration of access indication of the selected available storage locker; and cause, at least in part, the lock instruction to be communicated to the electronic locking mechanism based, at least in part, on one or more of a reception of the access code and an access authorization indicator, the access authorization indicator being associated with one or more of the confirmed financial transaction associated with use of the selected available storage locker and a management system operator input;

at least one solar energy collection unit configured to collect solar energy;

an energy storage unit configured to store the collected solar energy and supply power to the apparatus;

a canopy portion over the storage lockers of the plurality of storage lockers;

one or more canopy support members; and a base member configured to support the storage lockers of the plurality of storage lockers, the canopy portion, the one or more canopy support members, and the energy storage unit, wherein the at least one memory and the computer program code are further configured to, with the at least one processor, cause the apparatus to:

cause a message to be sent to a mobile device indicating that at least one storage locker of the plurality of storage lockers is available at a time after the accessibility report is displayed if the accessibility report indicates that all of the storage lockers are unavailable at the time the request to access at least one of the storage lockers of the plurality of storage lockers was made, at least one of the canopy support members is elongated and extends from a surface of the base member to a surface of the canopy portion, the energy storage unit is housed within the at least one elongated canopy support member, and the apparatus is independent of any external power source.

2. The apparatus of claim 1, further comprising:

a control unit comprising the user interface, the user interface further being configured to facilitate the access request, the financial transaction associated with use of the selected available storage locker, and the communication of the access message, the control unit being positioned remote from the storage lockers of the plurality of storage lockers; and a control unit housing, the control unit housing configured to support the user interface and accommodate the energy storage unit, wherein the control unit is configured to wirelessly communicate with the one or more electronic locking mechanisms and a storage locker access management system by way of a wireless communication network.

3. The apparatus of claim 2, further comprising:

an input interface, the input interface being configured to receive a user input associated with the access code, wherein the at least one memory and the computer program code are further configured to, with the at least one processor, cause the access code input at the input interface to be verified based, at least in part, on one or more of the lock instruction and a verification communication with the control unit that compares the user input with the access code.

4. The apparatus of claim 3, wherein the input interface is positioned on the door portion, and the apparatus further comprises an electronic locking mechanism status indicator configured to indicate the electronic locking mechanism is in the locked or unlocked status.

5. The apparatus of claim 4, wherein the input interface comprises a touch screen keypad configured to receive a manually input access code.

6. The apparatus of claim 3, wherein the lock instruction is stored in another memory associated with the one or more locking mechanisms, the verification of the access code being based, at least in part, on the lock instruction stored in the another memory.

7. The apparatus of claim 1, further comprising:

one or more control units comprising respective user interfaces, the user interfaces being configured to facilitate the access request, the financial transaction associated with use of the selected available storage locker, and the communication of the access message, the user interface comprising a touch screen keypad configured to receive a manually input access code, the control unit being positioned on the door portion, wherein the one or more control units are configured to communicate with the one or more electronic locking mechanisms and a storage locker access management system positioned remote from the one or more control units, the communication between the storage locker access management system being by way of a wireless communication network.

8. The apparatus of claim 1, wherein the canopy portion comprises the at least one solar energy collection unit, the one or more canopy support members have a channel within which one or more wires are run, and the one or more wires being configured to operatively connect the at least one solar energy collection unit to the energy storage unit.

9. The apparatus of claim 1, further comprising:

a display portion in communication with a storage locker access management system, the display portion being configured to display one or more images in accordance with a display instruction received from the storage locker access management system by way of a wireless communication network.

10. The apparatus of claim 1, wherein the base member is configured to elevate the storage lockers of the plurality of storage lockers to prevent water from entering the storage lockers of the plurality of storage lockers.

11. The apparatus of claim 1, wherein the access code is generated using a random number generator.

12. An apparatus comprising:

a plurality of storage lockers, each locker of the plurality of storage lockers comprising a corresponding door configured to be in one of a locked or an unlocked status based on a lock condition of an electronic locking mechanism;

at least one processor;

at least one memory including computer program code for one or more programs, the at least one memory and the computer program code configured to, with the at least one processor, cause the apparatus to:

process a request to access at least one of the storage lockers of the plurality of storage lockers to determine at least one of the storage lockers of the plurality of storage lockers is available to be accessed;

cause an accessibility report to be displayed on a user interface based on the request to access at least one of the storage lockers of the plurality of storage lockers, the accessibility report including an indication of which of the storage lockers of the plurality of storage lockers is determined to be available to be accessed;

process a selection associated with a particular determined available storage locker of the plurality of storage lockers to cause an access message to be generated and communicated, the access message comprising a locker number, an access code, and a duration of access indication of the selected available storage locker; and cause the electronic locking mechanism to be unlocked based on a reception of the access code;

at least one solar energy collection unit configured to collect solar energy; and an energy storage unit configured to store the collected solar energy and supply power to the apparatus, a canopy portion over the storage lockers of the plurality of storage lockers;

one or more canopy support members; and a base member configured to support the storage lockers of the plurality of storage lockers, the canopy portion, the one or more canopy support members, and the energy storage unit, wherein the at least one memory and the computer program code are further configured to, with the at least one processor, cause the apparatus to:

process a selection to access a storage locker of the plurality of storage lockers indicated by the accessibility report as being unavailable at the time the request to access at least one of the storage lockers of the plurality of storage lockers was made, and cause a message to be sent to a mobile device indicating that the selected unavailable storage locker of the plurality of storage lockers is available at a time after the accessibility report is displayed, at least one of the canopy support members is elongated and extends from a surface of the base member to a surface of the canopy portion, the energy storage unit is housed within the at least one elongated canopy support member, and the apparatus is independent of any external power source.

13. The apparatus of claim 12, wherein the canopy portion comprises the at least one solar energy collection unit, the one or more canopy support members have a channel within which one or more wires are run, and the one or more wires being configured to operatively connect the at least one solar energy collection unit to the energy storage unit.

14. The apparatus of claim 12, wherein the base member is configured to elevate the storage lockers of the plurality of storage lockers to prevent water from entering the storage lockers of the plurality of storage lockers.

15. The apparatus of claim 12, wherein the base member comprises:

one or more drain portions configured to collect water that is present on a surface of the base member; and one or more outlets configured to be selectively opened or closed so as to direct the water collected by the one or more drain portions in a selected direction.

16. The apparatus of claim 13, wherein the canopy portion is configured to be moved to adjust one or more of a height or an angular orientation of the canopy portion based on one or more of a time of day, a schedule, a location of the apparatus, or on demand.

17. An apparatus comprising:

a plurality of storage lockers, each storage locker of the plurality of storage lockers comprising a corresponding door configured to be in one of a locked or an unlocked status based on a lock condition of an electronic locking mechanism;

at least one processor;

at least one memory including computer program code for one or more programs, the at least one memory and the computer program code configured to, with the at least one processor, cause the apparatus to:

process a request to access at least one of the storage lockers of the plurality of storage lockers to determine at least one of the storage lockers of the plurality of storage lockers is available to be accessed;

cause an accessibility report to be displayed on a user interface based on the request to access at least one of the storage lockers of the plurality of storage lockers, the accessibility report including an indication of which of the storage lockers of the plurality of storage lockers is determined to be available to be accessed;

process a selection associated with a particular determined available storage locker of the plurality of storage lockers to cause an access message to be generated and communicated, the access message comprising a locker number, an access code, and a duration of access indication of the selected available storage locker; and cause the electronic locking mechanism to be unlocked based on a reception of the access code;

a canopy portion over the storage lockers of the plurality of storage lockers;

an energy storage unit;

one or more canopy support members; and a base member configured to support the storage lockers of the plurality of storage lockers, the canopy portion, the one or more canopy support members, and the energy storage unit, wherein the at least one memory and the computer program code are further configured to, with the at least one processor, cause the apparatus to:

process a selection to access a storage locker of the plurality of storage lockers indicated by the accessibility report as being unavailable at the time the request to access at least one of the storage lockers of the plurality of storage lockers was made, and cause a message to be sent to a mobile device indicating that the selected unavailable storage locker of the plurality of storage lockers is available at a time after the accessibility report is displayed, at least one of the canopy support members is elongated and extends from a surface of the base member to a surface of the canopy portion, and the energy storage unit is housed within the at least one elongated canopy support member.

18. The apparatus of claim 17, wherein some of the storage lockers of the plurality of storage lockers are larger than the other storage lockers of the plurality of storage lockers, and the message indicating that the selected unavailable storage locker of the plurality of storage lockers is available is based on a selected size of storage locker.

19. The apparatus of claim 17, wherein some of the storage lockers of the plurality of storage lockers are larger than the other storage lockers of the plurality of storage lockers, and the message indicating that the selected unavailable storage locker of the plurality of storage lockers is available is based on a price point associated with the storage lockers of the plurality of storage lockers.

* * * * *